US006095669A

United States Patent [19]

Cho

[11] Patent Number: 6,095,669

[45] Date of Patent: Aug. 1, 2000

[54] RECESSED LIGHTING FIXTURE FOR SLOPED CEILINGS AND BAFFLE RECEIVED THEREIN

[75] Inventor: Woo Hyun John Cho, Seoul, Rep. of Korea

[73] Assignee: Ilsung Moolsan Co., Ltd., Seoul, Rep. of Korea

[21] Appl. No.: 08/905,337

[22] Filed: Aug. 4, 1997

[51] Int. Cl.[7] ..... F21S 1/06

[52] U.S. Cl. ..... 362/365; 362/366; 362/147; 362/148; 362/372

[58] Field of Search ..... 362/148, 306, 362/365, 366, 389, 396, 372; 248/231.8, 298.1, 299.1

[56] References Cited

U.S. PATENT DOCUMENTS

| | | | |
|---|---|---|---|
| 4,491,902 | 1/1985 | Cangelosit | 362/389 |
| 4,729,080 | 3/1988 | Fremont et al. | 362/366 |
| 5,548,499 | 8/1996 | Zadeh | 362/366 |

*Primary Examiner*—Cassandra Spyrou
*Assistant Examiner*—Craig Curtis
*Attorney, Agent, or Firm*—Kennedy, Davis & Hodge, LLP

[57] ABSTRACT

A recessed lighting fixture for installation in a sloped ceiling which defines an opening therein for communicating light from the fixture to a space below the surface of the ceiling, in which a cylindrical housing having a closed end and an open end is secured to a frame at an oblique angle relative to the frame in order to position a lower edge of the housing in a plane defined by the sloped ceiling. Screws extend through slots in the housing, which screws guide the movement of the housing along the slots, whereby the housing is selectively moveable from a first position relative to the frame to a second position to position the lower edge of the housing in the plane of the ceiling in order to accommodate the thickness of the ceiling in which the fixture is installed. A mounting plate depends from the closed end of the housing and defines at least one arcuate slot therein extending substantially transverse to the longitudinal axis of the housing, for receiving and guiding movement of a socket connector, whereby a lamp in a socket attached to the socket connector directs light through the open end of the housing. A baffle is telescopically received within the housing. A lower end of the baffle is received in a gap defined by a pair of flanges which extend from an annular trim support that supports an ornamental trim ring.

22 Claims, 3 Drawing Sheets

RECESSED LIGHTING FIXTURE FOR SLOPED CEILINGS AND BAFFLE RECEIVED THEREIN

TECHNICAL FIELD

The present invention relates generally to recessed lighting fixtures. More particularly, the present invention relates to recessed lighting fixtures for installation in sloped ceilings and baffles for recessed lighting fixtures.

BACKGROUND OF THE INVENTION

Lights and lighting provide aesthetically attractive elements for interior spaces such as rooms. There are a variety of lighting fixtures which may be used to provide illumination in rooms. One type of lighting fixture is recessed into a space above the ceiling of a room. The surface of the ceiling defines an opening, and light from the fixture communicates through the opening into the room below the ceiling. Typically, the light emits from a bulb held in a socket which is contained within a housing. The housing mounts to a frame which rests on the interior surface of the ceiling.

There is a gap between the lower edge of the housing in the opening and the edge of the opening in the ceiling. This gap is covered by a trim plate which typically is secured to the housing. The trim plate provides a finished appearance for the recessed ceiling fixture.

The housing may also telescopically receive a baffle. The baffle is an elongated open-ended tube which baffles light communicated from the lamp in the socket of the recessed lighting fixture. Baffling absorbs light and eliminates glare. In known recessed lighting fixtures for sloped ceilings the lower end of the baffle defines a plane at an arcuate angle to the longitudinal axis of the baffle. This however results in the baffle having an elliptical opening which differs from an annular ornamental appearance provided by conventional recessed fixtures in horizontal ceilings, when viewed from below the ceiling.

Further, the lamp in the socket is disposed at an oblique angle to the floor below the ceiling. Preferably, as with recessed lighting fixtures in horizontal ceiling, the light communicates from the fixture in a plane perpendicular to the floor. To accomplish this, the socket is mounted for selective positioning within the housing. However, the existing mounts are awkward to reach and adjust whereby the lamp socket is positioned at a selected angle which preferably substantially counters the slope of the ceiling.

Accordingly, there remains a need in the art for an improved recessed lighting fixture for installation in sloped ceilings. It is to the provision of such that the present invention is directed.

SUMMARY OF THE PRESENT INVENTION

The present invention solves the need in the art by providing an improved recessed lighting fixture for sloped ceilings having an opening for communicating light from the fixture to a space below the surface of the ceiling. The fixture comprises a frame defining an opening from which a pair of arms extend on opposing sides of the annular opening. Each arm defines an upper hole near a distal end and a lower hole intermediate the frame and the distal end, for receiving screws therethrough. A cylindrical housing has a closed end and an open end defined by a plane at an oblique angle to a longitudinal axis of the housing. A first pair of elongated slots are formed in opposing sides of the housing for alignment with the arms and for receiving the screws therethrough. The housing extends through the opening in the frame. The screws extend through the slots into the upper and lower holes in the arms to connect the housing to the frame and also guide the movement of the housing along the slots, whereby the housing is selectively moveable from a first position relative to the frame to a second position in order to align a lower edge of the housing in a plane of the ceiling and thereby accommodate the thickness of the ceiling in which the fixture is installed. The screws are the tightened to secure the housing to the arms when the housing is in the selected position.

The lighting fixture includes a lamp socket which attaches to an L-shaped member having a connector flange that engages a mounting plate. The mounting plate depends from the closed end of the housing and defines at least one arcuate slot which is substantially transverse to the longitudinal axis of the housing. A threaded fastener connects the connector flange to the mounting plate. The fastener travels in the slot for selectively positioning the lamp socket at an oblique angle relative to the longitudinal axis of the housing, whereby light from the lamp in the socket is communicated from the fixture through the open end into the space below the ceiling. The lamp socket can thereby be positioned so that the light is emitted substantially perpendicular to the floor. A baffle comprising an open-ended cylinder with a lower end defining a plane at an oblique angle to a longitudinal axis of the baffle is telescopically received within the housing. A lower end of the baffle connects to an annular trim ring. A pair of flanges extend from the trim ring and define a gap which receives a lower edge of the baffle. A first of the flanges is disposed radially inwardly of an interior surface of the baffle and a second of the flanges is disposed radially outwardly of an exterior surface of the baffle, whereby the baffle in the plane of the ceiling conforms to an annular shape therein. An annular trim ring covers a gap between the lower end of the housing and the edge of the opening in the ceiling.

In another aspect the present invention provides a recessed lighting fixture for installation in a sloped ceiling during remodeling. The lighting fixture comprises a cylindrical housing having a closed end and an open end defined by a plane at an oblique angle to a longitudinal axis of the housing. A flange extends outwardly from the lower end of the housing. The lighting fixture includes a lamp socket which attaches to an L-shaped member having a connector flange for engaging a mounting plate and a socket plate extending laterally therefrom. The mounting plate depends from the closed end of the housing and defines at least one arcuate slot which is substantially transverse to the longitudinal axis of the housing. A threaded fastener connects the connector flange to the mounting plate and travels in the slot for selectively positioning a lamp socket at an oblique angle relative to the longitudinal axis of the housing, whereby light from the lamp in the socket is communicated from the fixture through the open end into the space below the ceiling. A baffle comprising an open-ended cylinder having a lower end defining a plane at an oblique angle to a longitudinal axis of the baffle is telescopically received within the housing. A lower end of the baffle connects to an annular trim ring. A pair of flanges extend from the trim ring and define a gap which receives a lower edge of the baffle. A first of the flanges is disposed radially inwardly of an interior surface of the baffle and a second of the flanges is disposed radially outwardly of an exterior surface of the baffle, whereby the baffle in the plane of the ceiling conforms to an annular shape therein. An annular trim ring covers a gap between the lower end of the housing and the edge of the opening in the ceiling.

The present invention further provides a baffle assembly for baffling light emitted from a recessed lighting fixture received in an opening in a ceiling while ornamentally shielding a gap between a lower edge of the recessed lighting fixture and an edge of the opening. The baffle assembly comprises an elongate cylindrical tube for being received within a housing of a recessed lighting fixture. The tube has a first end that defines a plane at an oblique angle to a longitudinal axis of the tube and a second end that defines a plane substantially perpendicular to the longitudianal axis. An annular ring defines an ornamental exterior trim surface and has a pair of spaced-apart annular concentrically-spaced flanges that extend from an interior surface. The flanges define a gap therebetween and receive therein the first end of the tube for configuring the first end to an annular shape. A first of the pair of flanges is disposed radially inwardly of an interior surface of the tube and a second of the pair of flanges is disposed radially outwardly of an exterior surface of the tube. An exterior perimeter portion of the ring extends radially laterally from the second of the pair of flanges to define a ledge. The annular ring is secured to the first end of the tube. An ornamental trim ring is received on the ledge of the annular ring, and thereby defines a baffle assembly for being received within a housing of a recessed lighting fixture, while ornamentally covering a gap between the housing and the ceiling. The baffle assembly is attached to the housing.

Objects, features and advantages of the present invention will become apparent upon a reading the following detailed description of the present invention, in conjunction with the appended drawings and claims.

DETAILED DESCRIPTION OF THE PREFERRED EMBODIMENTS

Figure 1:
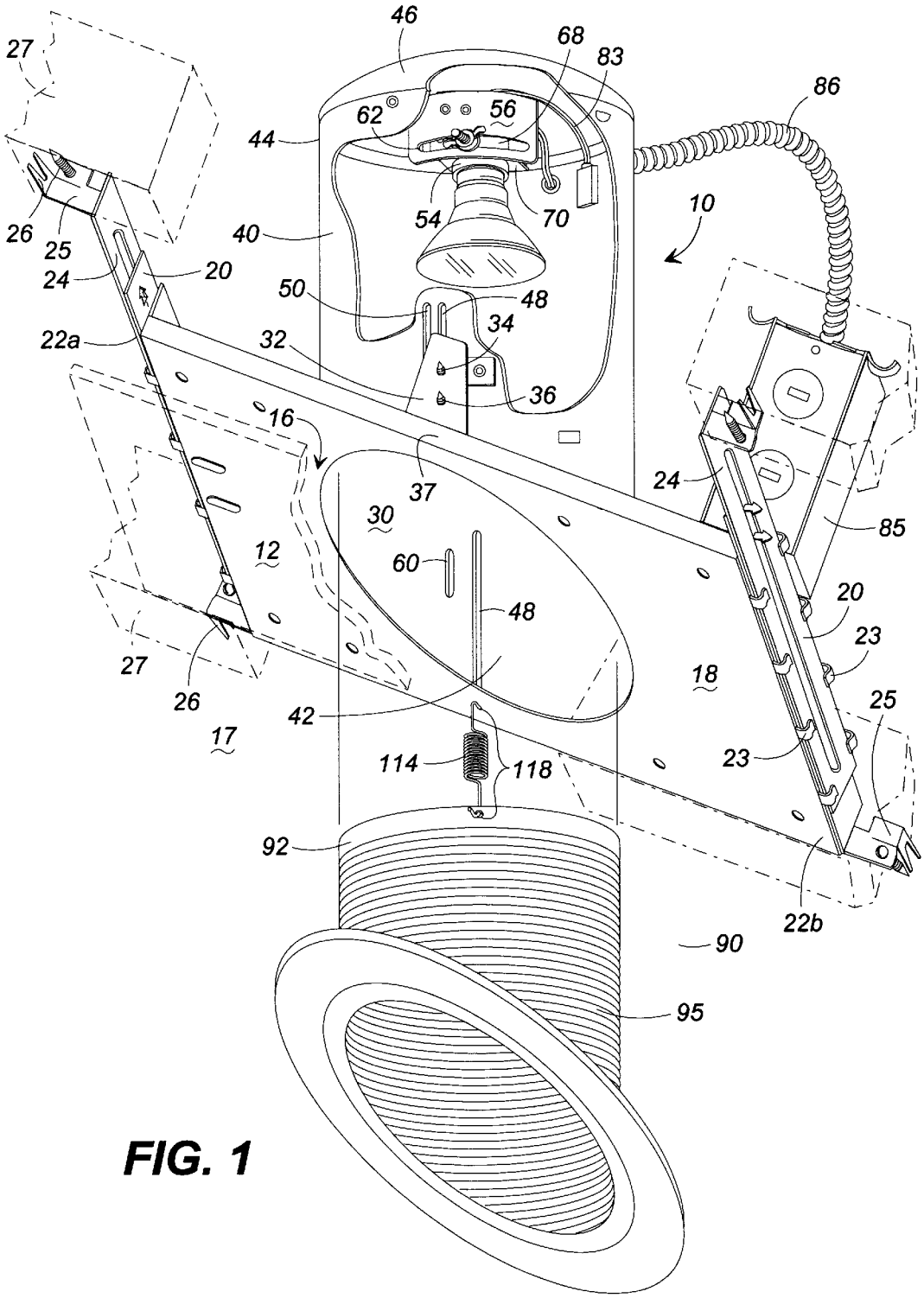
FIG. 1 is a perspective cut-away view illustrating a recessed lighting fixture installed in a sloped ceiling, according to the present invention.

Referring now in more detail to the drawings in which like parts have like identifiers, FIG. 1 is a perspective partially cut-away view of an embodiment of a recessed lighting fixture 10 made in accordance with the present invention for installing in a sloped ceiling 12 illustrated partially cut-away. The sloped ceiling 13 defines an opening generally 16 for communicating light from the recessed lighting fixture 10 into a room or space generally 17 below the ceiling. The fixture 10 includes a pan 18 which rests on an interior surface of the ceiling 12. The pan 18 is provided with a pair of bar hangers 20 which attach on respective opposing sides 22*a*, 22*b* of the pan 18. Conventional pans have a plurality of spaced-apart pairs of L-shaped flanges 23 which face each other and the pairs of flanges define channels for receiving the bar hangers 20 on the opposing sides 22*a*, 22*b* of the pan 18. The bar hangers 20 preferably comprise telescoping arms 24 which terminate at longitudinal distal ends in integtal fastener flanges 25. The flanges (25) define pointed teeth (26) for engaging wood joists 27 above the ceiling 12.

Figure 2:
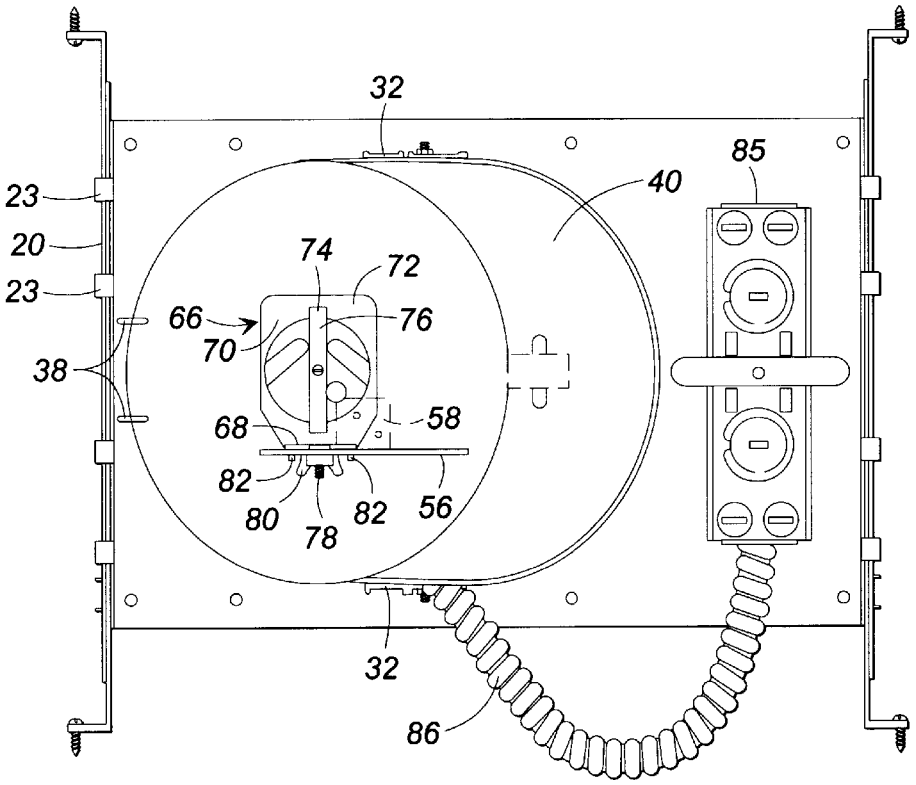
FIG. 2 is a top plan view of the recessed lighting fixture illustrated in FIG. 1.

The pan 18 defines an opening 30. A pair if arms 32 extend upwardly from the pan 18 on opposing sides of the opening 30. Each arm 32 defines an upper hole 34 and a lower hole 36. The terms "lower" and "upper" are used in their conventional directional sense, as the fixture 10 is installed in ceiling space with the pan 18 adjacent the ceiling surface and the upper hole 34 disposed outwardly of the ceiling and the lower hole 36 intermediate the upper hole and the ceiling. The upper hole 34 and the lower hole 36 define a line 37 which is preferably oriented at an oblique angle relative to the pan 18, for a purpose discussed below. As best shown in FIG. 2, the illustrated embodiment includes a pair of slots 38 formed in the pan 18 between the opening 30 and a side 39 of the pan. The slots 38 may be cut to form an open notch in the side of the pan 18, which facilitates inserting the pan 18 into the space 12 over the ceiling 12, as discussed below.

The fixture 10 includes an elongated cylindrical housing 40 which is received in the opening 30 of the pan 18. The diameter of the housing 40 is less than that of the opening 30, for receiving the housing therethrough as discussed below. The housing 40 has an open lower end 42 and an upper end 44 closed by a cap 46. In the illustrated embodiment, the lower end 42 defines a plane at an oblique angle to a longitudinal axis of the housing 40. In the illustrated embodiment, the cap 46 is riveted to the upper end 44 of the housing 40. In the illustrated embodiment, the cap 46 is substantially dome-shaped. The sidewall of the housing 40 includes a first pair of elongated slots 48. The slots 48 are on radially opposing sides of the housing 40. The slots 48 are preferably disposed parallel to a longitudinal axis of the housing. The slots 48 align with the arms 32. As discussed below, the slots 48 receive screws 49 therethrough, which screws engage the upper hole 34 and the lower hole 36 in order to secure the housing 40 to the arms 32 and thereby to the pan 18. This disposes the housing 40 at an oblique angle to the pan 18. In the illustrated embodiment, a second pair of slots 50 are formed in the sidewall of the housing 40. One of the second pair of slots 50 is formed adjacent a respective one of the first pair of the slots 48. The slots 50 may be oriented at an oblique angle relative the first slots 48, although in the illustrated embodiment, the slots 50 are parallel to the respective slot 48.

Figure 3:
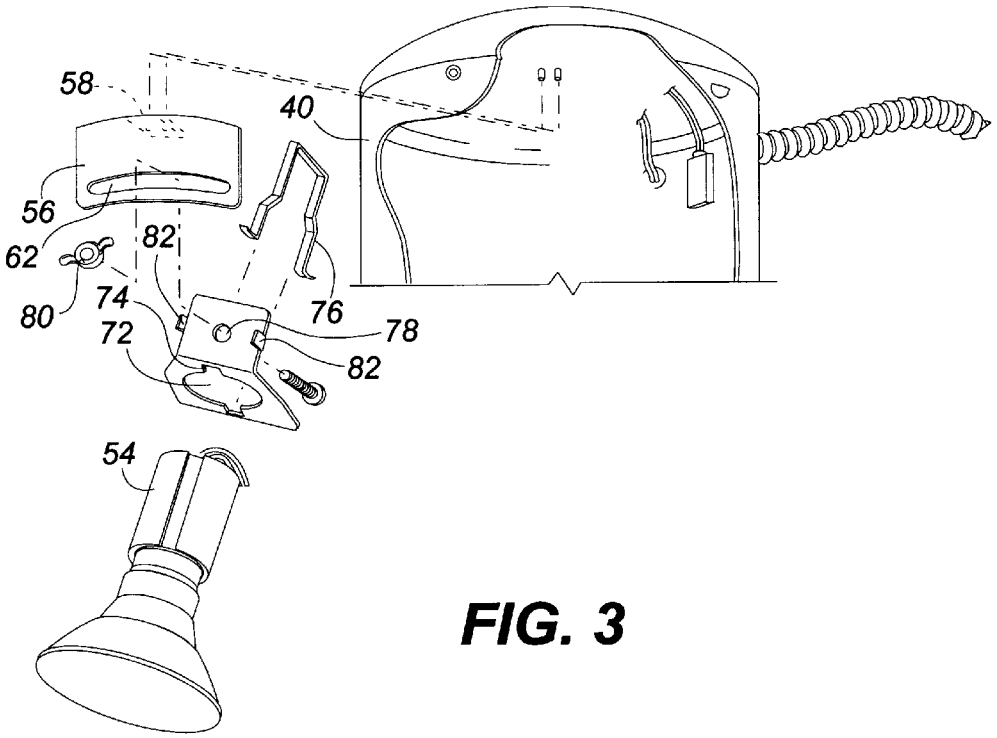
FIG. 3 is a detailed perspective exploded view of a mounting bracket light socket for the recessed lighting fixture illustrated in FIG. 1.

With reference to FIG. 3, the recessed lighting fixture 10 includes a socket 54 illustrated exploded away from the housing 40 for receiving a light bulb, as discussed below. A mounting plate 56 for the socket 54 is secured in the upper portion of the housing 40. The mounting plate 56 depends from the cap 46 and is disposed in a plane parallel to the longitudinal axis of the housing 40. The mounting plate 56 includes a laterally extending flange 58. A pair of rivets extend through the cap 46 and the flange 58 for fastening the mounting plate 56 to the closed end of the housing. The plate 56 defines at least one arcuate slot 62. The slot 62 is oriented substantially transverse to a longitudinal axis of the housing 40.

A socket support 66 attaches to the mounting plate 56. The socket support 66 is an L-shaped member having a connector flange 68 which is disposed parallel to the mounting plate 56. A socket plate 70 extends laterally from the connector flange 68 and thereby defines the L-shaped socket support 66. The socket plate 70 defines an opening which receives the socket 54. The opening 72 defines a pair of opposed notches 74. A clip 76 attached to the socket 54 engages the notches 74 in the opening for securing the socket to the socket plate 70.

A threaded fastener 78 extends laterally from the connector flange 68 for passing through the slot 62 in the mounting plate 56. A nut 80 threadingly engages the distal end of the threaded fastener 74 for securing the socket support 66 to the mounting plate 56. In the illustrated embodiment, a pair of tabs 82 extend laterally from the connector flange 68 on opposing sides of the fastener 78. The tabs 82 and the fastener 78 are disposed in a line for being received in the slot 62 of the mounting plate 56. The tabs 82 are received in the slot 62 to maintain the orientation of the socket 54 relative the longitudinal axis of the housing, as discussed below. In an alternate embodiment, the mounting plate 56 has a pair of arcuate slots 62. Two fasteners connect the flange 68 to the mounting plate. The tabs 82 are not used in this embodiment.

With continuing reference to FIGS. 1 and 2, electrical conductors 83 connect to the socket 54 and extend through an opening in the housing 40 to a conventional electrical junction box 85 mounted to the pan 18 laterally of the housing 40. The conductors 83 pass through conventional shielded conduit 86 which connects at distal ends to the housing 40 and the junction box 85.

Figure 4:
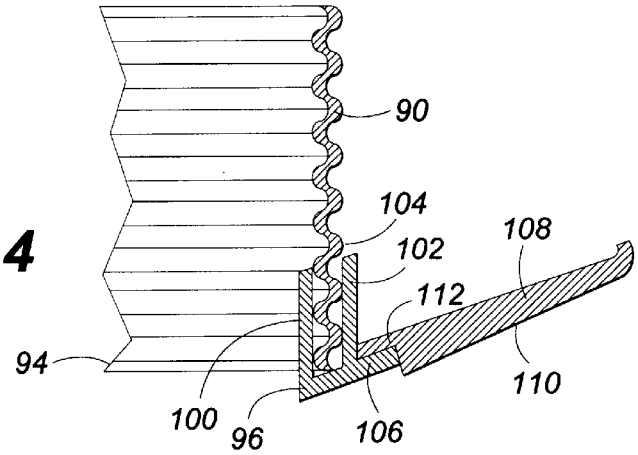
FIG. 4 is a detailed cross-sectional view of a baffle and trim ring used with the recessed lighting fixture illustrated in FIG. 1.

The housing 40 telescopically receives a cylindrical baffle 90 which is open at an upper end 92 and a lower end 94 (shown in FIG. 4). The upper end 92 defines a plane perpendicular to a longitudinal axis of the baffle 90. The lower end 94 defines a plane at an oblique angle to the longitudinal axis. The sidewall 95 of the baffle 90 is preferably corrugated at least through a longitudinal portion of the baffle. The corrugations define ridges and grooves which cooperate to baffle the light communicated through the fixture 10 and thereby reduce glare around the ceiling. The baffle 90 is made of aluminum or of plastic by molding. In an alternate embodiment, the baffle 90 is smooth and not corrugated with a finished, shiny reflective interior surface. The interior surface is preferably finished with a clear or ornamentally colored finish, such as gold or black.

FIG. 4 is a cross-sectional view of the lower end 94 of the baffle 90, to illustrate a trim support ring 96 received thereon. The trim support ring 96 is an annular member having a pair of spaced-apart concentric flanges 100 and 102 which extend upwardly. The spaced-apart flanges 100 and 102 define a gap 104 therebetween for receiving the lower end 94 of the baffle 90. The radially inner flange 100 is thereby disposed radially inwardly of the interior surface of the wall 95 of the baffle 90. A lip 106 extends laterally from a radially outer portion of the support ring 96. A trim ring 108 having a first finished surface 110 is received on the lip 104 of the support ring 96. The trim ring 108 defines an annular recess 112 on a radially inward portion of the annular ring. The recess 112 receives the lip 104 of the support ring 96. The trim ring 96 is preferably molded plastic. The exterior surface of the trim ring 90 and the support ring 96 have an ornamentially attractive finished surface, which may be shiny and reflective, or matte, in clear, gold, black, or other selected finish colors.

Referring to FIG. 1, a pair of springs 114 having hooks 118 at respective distal ends secure the baffle 90 to the housing 40. The hook 118 at one end of each spring 114 engages the upper end of the baffle 90. The hook 118 at the other end of the spring 114 engages an opening or slot in the housing 40 (not illustrated). In alternate embodiment, pressure springs formed of bent metal strips, insert into slots in the housing and bear against the side of the baffle.

The lighting fixture 10 of the present invention is installed above a ceiling 12 to provide an ornamental lighting effect to a room 17 below the ceiling. For new construction, the fixture 10 installs readily to joists 27 in an exposed ceiling area of a room 17. The arms 24 of the bar hangers 20 are extended laterally to bring the flanges 25 into engagement with the opposing joists 27 in the ceiling space 17. The flanges 25 are hammered to drive the teeth 26 into the wood joists 27 to suspend the pan 18 between the joists. Electrical connections are made in the junction box 85 to connect the fixture 10 to a supply of electricity. The trim ring 108 is then slidingly received over the baffle 90 and the recessed portion 112 engages the lip 106 of the trim support ring 96. The baffle 90 is then installed by connecting the springs to housing 40. The baffle is subsequently removed for installations of the ceiling 12 and thereafter replaced. The trim ring 106 covers the gap between the lower edge 42 of the housing 40 and the opening 16 in the ceiling 12 to provide a finished appearance for the recessed lighting fixture 10.

The orientation of the socket 54 is then adjusted. The socket 54 is preferably oriented substantially perpendicular to the floor of the room below the ceiling. The nut 80 on the threaded fastener 78 is loosened so that the socket support 66 is freely movable along the slot 62. The socket support 66 is positioned on the mounting plate 56 so that the socket 54 is oriented at a selected position. The nut 80 is tightened to secure the socket 54 in the selected position.

The ceiling 12 is thereafter installed, with the opening 16 formed therein. The baffle 90 and trim ring 106 are first removed, and the ceiling installed. The screws 49 securing the housing 40 to the arms 32 are loosened. The housing 40 is moved vertically relative the pan 18 through the opening 30 in order to position the edge of the lower end 42 in a plane substantially aligned with the plane of the ceiling 12. The screws are thereafter tightened to secure the housing 40 to the pan 18, and the baffle 90 and trim ring 108 are then replaced.

The lighting fixture 10 of the present invention can also be installed in existing ceilings. A notch in the pan 18 is formed by separating a cut-out notch from the pan 18 by cutting the slots 38 between the opening 30 in the pan and the side 39 of the pan. The housing 40 is removed from the pan 18 by detaching the screws 49 from engagement with the arms 32. An opening is then formed in the ceiling 12. Appropriate electrical connections from the space 17 above the ceiling 12 are made with the electrical conductors 83 in the junction box 85 of the fixture 10. The pan 18 is then positioned in the space 17. The pan 18 is pushed to insert the notch into an edge of the opening in the ceiling 12. The pan 18 is thereafter rotated in order to bring the pan upwardly through the opening. The pan 18 is preferably disposed with the junction box 85 on the low side of the sloping ceiling 12.

The housing 40 is thereafter pushed upwardly into the space 17 through the hole in the pan 18. The slots 50 in the housing 40 are then aligned with the arms 32. The screws 49 are reinserted through the slots 50 into engagement with the upper hole 34 and the lower hole 36 in the arms 32. The screws 49 are tightened in order to secure the housing 40 to the pan 18. The lower edge 42 of the housing 40 is disposed in a plane defined by the ceiling 14.

The orientation of the socket 54 relative a longitudinal axis of the housing 40 is thereafter adjusted. The nut 80 is loosened to loosen the engagement of the socket support 66 relative the mounting plate 56. The socket support 66 is moved along the arcuate slot 62 until the socket 54 is in the selected position and the nut 80 is thereafter tightened. The baffle 90 and the trim ring 108 are thereafter assembled as discussed above, and the baffle 90 is slidingly inserted into the housing 40 and connected thereto.

The angle of the housing 40 relative to the ceiling 12 can be adjusted by positioning the screws 49 in the second slots 50 for engaging the upper holes 34 in the arms 32. The screw 49 inserted through the second slot 50 into the upper hole 34 and the screw 49 inserted through the first slot 48 into the lower hole 36 defines a line at second oblique angle to the longitudinal axis of the housing 40. With the second slot 50 spaced apart from the first slot 48, this line is at an angle different from the angle of the line defined when positioning the screws 49 in the first slots 48.

Figure 5:
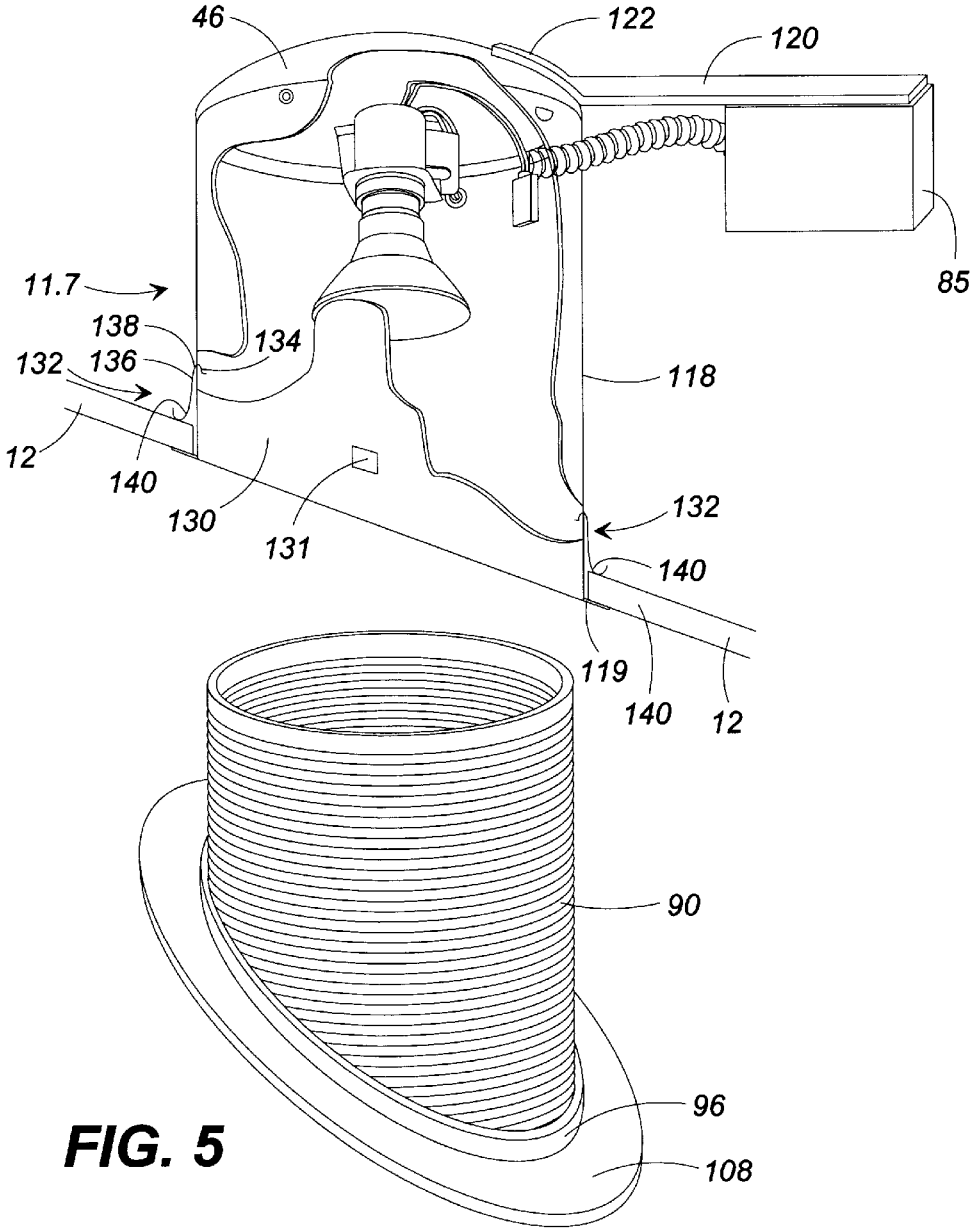
FIG. 5 is a perspective view of an alternate embodiment of the recessed lighting fixture according to the present invention.

FIG. 5 is a perspective view of an alternate embodiment of a recessed lighting fixture 117 according to the present invention. A housing 118 is used separately from the pan 18 for installation in an existing ceiling during a remodeling project. In this alternate embodiment, the housing 118 defines a flange 119 that extends radially outwardly from the lower end. A support member 120 attaches at a first end 122 to cap 46 with a plurality of rivets. The support member 120 extends laterally from the housing 118. The electrical junction box 85 connects to a second end of the support member 120. A lower portion generally 130 of the housing 117 includes three spaced-apart transverse slots 131 for receiving ceiling mount clips 132. The clips have a substantially U or V-shape with an interior leg 134 and an exterior leg 136 connected at an apex 138. The clips 132 are preferably formed of a spring metal. The interior leg 134 abuts the interior surface of the housing 117. The exterior leg 136 extends from the apex 138 outwardly through the slot 131 to the exterior and to a distal end 140.

The remodeling housing 117 illustrated in FIG. 5 is installed in an existing ceiling 12 by first cutting an elliptical hole in the ceiling. The electrical junction box 85 is opened and electrical connections made for communicating electric current from a supply to the socket 54. The electrical junction box 85 is then closed. The fixture 117 is then positioned in the ceiling space. First, the support member 120 with the electrical junction box 85 is then pushed upwardly through the opening in the ceiling 12. The fixture 117 is then rotated so that the housing 118 inserts through the opening. The housing 118 is pushed upwardly until the flange 119 is fixed against the ceiling 12. The ceiling mount clips 132 are then installed. The exterior leg 136 of each of the clips 132 is pushed through the slot 131 in the housing 117. The clip 132 is pushed upwardly and outwardly to dispose the exterior leg 136 outwardly of the housing. The apex 138 of the clip 132 rests in the slot 131 of the wall of the housing 40. The interior leg 134 abuts the interior surface. The exterior leg 136 extends outwardly with the distal end 140 baring against the interior surface of the ceiling 12. Preferably three clips are used to secure the housing 117 to the ceiling 12. The orientation of the socket 54 is adjusted as described above, and the baffle 90 with the trim plate is inserted into the housing.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A recessed lighting fixture for installation in a sloped ceiling which defines an opening therein for communicating light from the fixture to a space below the surface of the ceiling, comprising:

a frame defining an annular opening;

a pair of arms extending from the frame on opposing sides of the annular opening and each arm defining therein an upper hole near a distal end and a lower hole intermediate the frame and the distal end, for receiving screws therethrough;

a cylindrical housing having a closed end and an open end defined by a plane at an oblique angle to a longitudinal axis of the housing and defining a first pair of elongated slots in opposing sides of the housing for alignment with the ears and for receiving screws therethrough, said housing extending through the annular opening in the frame;

screws extending through the slots and into the upper and lower holes in the arms, whereby the screws guide the movement of the housing along the slots, the housing being selectively moveable from a first position relative to the frame to a second position to position a lower edge of the housing in a plane of the ceiling in order to accommodate the thickness of the ceiling in which the fixture is installed, by selectively sliding the housing longitudinally along the slots, with the screws being tightened to secure the housing to the arms when the housing is in the selected position;

a mounting plate depending from the closed end of the housing and defining at least one arcuate slot therein extending substantially transverse to the longitudinal axis of the housing;

an L-shaped member comprising a connector flange for engaging the mounting plate and a socket plate extending laterally therefrom;

a lamp socket attached to the socket plate;

means operatively guided by the slot in the mounting plate for selectively securing the connector flange thereto, whereby the lamp socket is selectively positioned at a first oblique angle relative to the longitudinal axis of the housing by sliding the L-shaped member along the arcuate slot and being secured thereto in the selected position, whereby a lamp in the lamp socket directs light through the open end of the housing at a substantially perpendicular angle relative to a floor of a space below the ceiling, the means being operatively accessed offset from the socket; and a pair of electrical conductors for connecting the lamp socket to a supply of electrical current.

2. The recessed lighting fixture as recited in claim 1, wherein the upper hole and the lower hole in the arms define a line at a first oblique angle to the frame, whereby the housing is secured in the opening in the frame at the first oblique angle thereto.

3. The recessed lighting fixture as recited in claim 1, further comprising a second pair of slots defined in the housing, each one of the second pair of slots spaced-apart from one of the first pair of slots, whereby the screw through the upper hole in the arm is selectively passed through the second slot for orienting the housing at a second oblique angle relative to the frame.

4. The recessed lighting fixture as recited in claim 3, wherein the second slot is spaced-apart and parallel to the first slot.

5. The recessed lighting fixture as recited in claim 1, further comprising a baffle telescopically received within the housing, the baffle comprising an open-ended cylinder having a lower end defining a plane at an oblique angle to a longitudinal axis of the baffle.

6. The recessed lighting fixture as recited in claim 5, further comprising an annular ring defining an ornamental exterior trim surface and having a pair of spaced-apart flanges extending from an interior surface thereof, which flanges define a gap for receiving therein the lower end of the baffle for being configured into an annular shape in a plane parallel to the sloped ceiling, a first of the flanges being disposed radially inwardly of an interior surface of the baffle and a second of the flanges being disposed radially outwardly of an exterior surface of the baffle.

7. The recessed lighting fixture as recited in claim 6, further comprising means for attaching the lower end of the baffle in the gap to the flanges of the annular ring.

8. The recessed lighting fixture as recited in claim 7, wherein means for attaching comprises fasteners extending through the flanges and a portion of the lower end of the baffle, whereby the annular ring and the baffle are attached together.

9. The recessed lighting fixture as recited in claim 6, wherein the annular ring further comprises a radially exterior lip; and further comprising an ornamental trim ring received on the lip of the annular ring prior to the baffle being telescopically received within the housing, whereby the annular ring and the trim ring ornamentally cover a gap in an opening in the ceiling between the lower edge of the housing and the opening.

10. The recessed lighting fixture as recited in claim 1, wherein the securing means comprises a pair of threaded bolts extending through the slots in the mounting plate and nuts received on distal ends thereof.

11. A recessed lighting fixture for installation in a sloped ceiling which defines an opening therein for communicating light from the fixture to a space below the surface of the ceiling, comprising:

a cylindrical housing having a closed end and an open end defined by a plane at an oblique angle to a longitudinal axis of the housing;

a mounting plate depending from the closed end of the housing and defining at least one pair of spaced-apart arcuate slot therein extending substantially transverse to the longitudinal axis of the housing;

an L-shaped member comprising a connector flange for engaging the mounting plate and a socket plate extending laterally therefrom;

a lamp socket attached to the socket plate;

means operatively guided by the slot in the mounting plate for selectively securing the connector flange thereto, whereby the socket is selectively positioned relative the longitudinal axis of the housing by sliding the L-shaped member along the arcuate slot and being secured thereto in the selected position, whereby a lamp in the lamp socket directs light through the open end of the housing;

a support bar rigidly connected to the closed end of the housing and extending laterally therefrom;

an electrical junction box attached to the support; and a pair of electrical conductors extending from the lamp socket for connecting the lamp socket within the electrical junction box to a supply of electrical current.

12. The recessed lighting fixture as recited in claim 11, further comprising a baffle telescopically received within the housing, the baffle comprising an open-ended cylinder having a lower end defining a plane at an oblique angle to a longitudinal axis of the baffle.

13. The recessed lighting fixture as recited in claim 12, further comprising an annular ring defining an ornamental exterior trim surface and having a pair of spaced-apart flanges extending from an interior surface thereof, which flanges define a gap for receiving therein the lower end of the baffle for being configured into an annular shape in a plane parallel to the sloped ceiling, a first of the flanges being disposed radially inwardly of an interior surface of the baffle and a second of the flanges being disposed radially outwardly of an exterior surface of the baffle.

14. The recessed lighting fixture as recited in claim 13, further comprising means for attaching the lower end of the baffle in the gap to the annular ring.

15. The recessed lighting fixture as recited in claim 14, wherein means for attaching comprises fasteners extending through the flanges and a portion of the lower end of the baffle, whereby the annular ring and the baffle are attached together.

16. The recessed lighting fixture as recited in claim 13, wherein the annular ring further comprises a radially exterior lip; and further comprising an ornamental trim ring received on the lip of the annular ring prior to the baffle being telescopically received within the housing, whereby the annular ring and the trim ring ornamentally cover a gap in the opening in the ceiling between the lower edge of the housing and the opening.

17. The recessed lighting fixture as recited in claim 11, wherein the securing means comprises a pair of threaded bolts extending through the slots in the mounting plate and nuts received on distal ends thereof.

18. A recessed lighting fixture for installation in a sloped ceiling which defines an opening therein for communicating light from the fixture to a space below the ceiling, comprising:

a cylindrical housing having a closed end and an open end defined by a plane at an oblique angle to a longitudinal axis of the housing;

a flange extending outwardly laterally from a lower edge of the open end for bearing against a lower surface of the ceiling;

means for holding the housing to the ceiling;

a mounting plate depending from the closed end of the housing and defining at least one arcuate slot therein extending substantially transverse to the longitudinal axis of the housing;

an L-shaped member comprising a connector flange for engaging the mounting plate and a socket plate extending laterally therefrom;

a lamp socket attached to the socket plate;

means operatively guided by the slot in the mounting plate for selectively securing the connector flange thereto, whereby the lamp socket is selectively positioned relative the longitudinal axis of the housing at a selected angle by sliding the L-shaped member along the arcuate slot and being secured thereto in the selected position, whereby a lamp in the lamp socket directs light through the open end of the housing at a substantially perpendicular angle to a floor of a space below the ceiling, the means being operatively accessed offset from the socket; and a pair of electrical conductors for connecting the lamp socket to a supply of electrical current.

19. The recessed lighting fixture as recited in claim 18 wherein means for holding comprises spring arms that extend laterally from a lower portion of the housing.

20. A baffle assembly for baffling light emitted from a recessed lighting fixture received in an opening in a ceiling while ornamentally shielding a gap between a lower edge of the recessed lighting fixture and an edge of the opening, comprising:

an elongate cylindrical tube for being received within a housing of a recessed lighting fixture, the tube having a first end that defines a plane at an oblique angle to a longitudinal axis of the tube, and a second end that defines a plane substantially perpindicular to the longitudianal axis;

an annular ring defining an ornamental exterior trim surface and having a pair of spaced-apart annular concentrically-spaced flanges extending from an interior surface thereof, which flanges define a gap therebetween and receiving therein the first end of the tube for configuring the first end to an annular shape, a first of the pair of flanges being disposed radially inwardly of an interior surface of the tube and a second of the pair of flanges being disposed radially outwardly of an exterior surface of the tube, and an exterior perimeter portion of the ring extending radially laterally from the second of the pair of flanges to define a ledge;

means for securing the annular ring to the first end of the tube with a portion thereof disposed in the gap between the flanges; and an ornamental trim ring received on the ledge of the annular ring to define a baffle assembly for being received within a housing of a recessed lighting fixture, whereby the annular ring and the trim ring ornamentally and cooperatively cover a gap in an opening in an ceiling between an edge of the housing and the opening; and means for attaching the baffle assembly to the housing.

21. The baffle assembly as recited in claim 20, wherein means for securing comprises fasteners extending through the flanges and the portion of the of the tube, whereby the annular ring and the tube are attached together.

22. The baffle assembly as recited in claim 20, wherein the trim ring defines a recessed portion that matingly receives the ledge of the annular ring.

* * * * *

UNITED STATES PATENT AND TRADEMARK OFFICE

CERTIFICATE OF CORRECTION

PATENT NO. : 6,095,669
DATED : August 1, 2000
INVENTOR(S) : Woo Hyun John Cho

It is certified that error appears in the above-identified patent and that said Letters Patent is hereby corrected as shown below:

Column 8,
Line 15, "ears" should be deleted and replaced with -- arms --.

Column 9,
Line 43, "pair of spaced apart" should be deleted.

Column 10,
Lines 30-31, "a pair of threaded bolts extending through the slots in the mounting plate and nuts" should be deleted and replaced with -- a threaded bolt extending through the slot in the mounting plate and a nut --

Signed and Sealed this

Second Day of September, 2003

JAMES E. ROGAN
*Director of the United States Patent and Trademark Office*